US012188306B2

(12) United States Patent
Jansson et al.

(10) Patent No.: US 12,188,306 B2
(45) **Date of Patent: *Jan. 7, 2025**

(54) DRILL STRING JOINT DESIGN

(71) Applicant: SANDVIK MINING AND CONSTRUCTION TOOLS AB, Sandviken (SE)

(72) Inventors: Tomas Jansson, Sandviken (SE); Anders Nordberg, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 2 days.

This patent is subject to a terminal disclaimer.

(21) Appl. No.: 18/026,406

(22) PCT Filed: Sep. 16, 2021

(86) PCT No.: PCT/EP2021/075470

§ 371 (c)(1),
(2) Date: Mar. 15, 2023

(87) PCT Pub. No.: WO2022/058420

PCT Pub. Date: Mar. 24, 2022

(65) Prior Publication Data

US 2023/0383608 A1 Nov. 30, 2023

(30) Foreign Application Priority Data

Sep. 17, 2020 (EP) ..... 20196583

(51) Int. Cl.
*E21B 17/042* (2006.01)

(52) U.S. Cl.
CPC ..... *E21B 17/0426* (2013.01)

(58) Field of Classification Search
CPC ..... E21B 17/0426; E21B 17/042
See application file for complete search history.

(56) References Cited

U.S. PATENT DOCUMENTS 3,067,593 A * 12/1962 McCool ..... E21B 17/042 464/902
4,253,687 A * 3/1981 Maples ..... E21B 17/0426 285/332.3

(Continued)

FOREIGN PATENT DOCUMENTS

DE 2800887 A1 7/1978
EP 2845992 B1 1/2016

(Continued)

*Primary Examiner* — Matthew Troutman
*Assistant Examiner* — Fannie Kee
(74) *Attorney, Agent, or Firm* — Corinne R. Gorski

(57) ABSTRACT

A drill string rod is arranged to form part of an assembly of connected drill string rods. The drill string rod includes an elongate central rod portion extending axially between a male and female end. The central rod portion is a hollow-cylindrical defined by an inner first diameter ($d_{rod}$) and an outer second diameter ($D_{rod}$). The male end includes a spigot having a base projecting axially from a shoulder that axially separates the spigot and the central rod portion. The female end includes a sleeve portion configured to fit to the spigot. The base has an outer thread and the sleeve portion has an inner thread, the inner thread corresponding to the outer thread such that the inner thread of the sleeve portion is attachable to the outer thread of the base of the spigot of a further drill string rod of the assembly.

12 Claims, 3 Drawing Sheets

(56) References Cited

U.S. PATENT DOCUMENTS

| | | | | |
|---|---|---|---|---|
| 4,332,502 | A | 6/1982 | Wormald et al. | |
| 4,398,756 | A | 8/1983 | Duret et al. | |
| 4,687,368 | A | 8/1987 | Eklof et al. | |
| 6,244,631 | B1 * | 6/2001 | Payne | E21B 17/042 285/333 |
| 6,767,156 | B1 | 7/2004 | Larsson | |
| 7,185,721 | B2 | 3/2007 | Carlstrom et al. | |
| 11,808,086 | B2 * | 11/2023 | Jansson | E21B 17/0426 |
| 2002/0074797 | A1 | 6/2002 | Liljebrand et al. | |
| 2005/0062288 | A1 * | 3/2005 | Alaria | E21B 17/042 285/357 |
| 2005/0189147 | A1 * | 9/2005 | Williamson | E21B 17/042 175/320 |
| 2009/0152014 | A1 * | 6/2009 | Nava | E21B 17/0426 175/414 |
| 2010/0001522 | A1 | 1/2010 | Carlstroem et al. | |
| 2011/0012347 | A1 * | 1/2011 | Pacheco | E21B 17/042 285/333 |
| 2011/0018262 | A1 * | 1/2011 | Peter | E21B 17/042 285/333 |
| 2016/0208561 | A1 * | 7/2016 | Ahola | E21B 17/0426 |
| 2016/0215572 | A1 * | 7/2016 | Jansson | E21B 17/042 |
| 2016/0222737 | A1 * | 8/2016 | Rosen | E21B 17/042 |
| 2017/0321496 | A1 | 11/2017 | Lee et al. | |
| 2018/0135783 | A1 | 5/2018 | Wickstrom et al. | |
| 2018/0187496 | A1 * | 7/2018 | Kinsella | E21B 17/042 |
| 2022/0154538 | A1 * | 5/2022 | Jansson | E21B 17/0426 |

FOREIGN PATENT DOCUMENTS

| | | | | |
|---|---|---|---|---|
| WO | 0138685 | A1 | 5/2001 | |
| WO | WO-2006092649 | A1 * | 9/2006 | E21B 17/042 |
| WO | 2012072734 | A1 | 6/2012 | |
| WO | 2015032659 | A1 | 3/2015 | |
| WO | WO-2016033687 | A1 * | 3/2016 | E21B 17/042 |
| WO | 2016188862 | A1 | 12/2016 | |

* cited by examiner

DRILL STRING JOINT DESIGN

RELATED APPLICATION DATA

This application is a § 371 National Stage Application of PCT International Application No. PCT/EP2021/075470 filed Sep. 16, 2021 with priority to EP 20196583.7 filed Sep. 17, 2020.

TECHNICAL FIELD

The present invention relates to drill string rods for use with drill bits for percussion rock drilling. Specifically, the invention relates to improving the reliability and longevity of such drill string rods.

BACKGROUND

Percussion drilling is used to create a long borehole via a plurality of elongate drill string rods coupled together end-to-end by interconnected male and female threaded ends. The well-established technique breaks rock by hammering impacts transferred from a rock drill bit, mounted at one end of the drill string, to the rock at the bottom of the borehole. Typically, the energy required to break the rock is generated by a hydraulically driven piston that contacts the end of the drill string (via a shank adaptor) to create a stress (or shock) wave that propagates through the drill string and ultimately to the rock. Conventional male and female threaded couplings are described in U.S. Pat. Nos. 4,332,502; 4,398,756; 4,687,368 and DE 2800887.

The male and female threaded ends of neighboring drill rods are coupled to create the drill string and the joint is typically subjected to large forces during drilling. These forces fatigue the coupling and lead to wear and breakage within the threaded portion of the joint. Typically, it is the threaded male spigot that is damaged and determines the operational lifetime of the coupling. U.S. Pat. No. 6,767,156 discloses a threaded joint between two percussive drill rods having conical guiding surfaces provided at the leading axial ends of the male and female portions in an attempt to achieve a secure coupling and prevent damage to the threads.

EP2845992B1 by the present applicant aims to mitigate the above-mentioned drawbacks.

One problem with known drill string joint designs is that failure occurs due to bending which originates from non-straight holes. Cracking may occur is the spigot or in the sleeve portion therefore reducing the reliability and longevity of the drill string rods.

Hence, there is a need for a drill string joint design having reduced stress and increased bending resistance, therefore improving the reliability and increasing the lifetime of the drill string rods.

SUMMARY

An object of the invention is to provide a drill string rod with improved reliability and longevity of the drill string rods. The drill string rod is to form part of an assembly of connected such drill string rods. The drill string rod comprises an elongate central rod portion extending axially between a male end and a female end. The central rod portion is hollow-cylindrical defined by an inner first diameter (drod) and an outer second diameter (Drod). The male end comprises a spigot, wherein the spigot comprises a base projecting axially from a shoulder that axially separates the spigot and the central rod portion. The female end comprises a sleeve portion configured to fit to the spigot. Also, the base is provided with an outer thread and the sleeve portion is provided with an inner thread, wherein the inner thread corresponds to the outer thread such that the inner thread of the sleeve portion is attachable to the outer thread of the base of the spigot of a further drill string rod of the assembly. In a radial plane to the longitudinal axis of the drill string rod, the base of the spigot is defined by an outer third diameter (Dspigot) and an inner fourth diameter (dspigot) and the sleeve portion is defined by an outer fifth diameter (Dsleeve) and an inner sixth diameter (dsleeve). The present invention is limited to drill string rods with an outer second diameter (Drod) between 30 and 60 mm, preferably between 40 and 60 mm. Csleeve and Cspigot are related to the diameters of the drill string rod as defined by the following formulas:

$$C_{sleeve} = \frac{D_{rod} \cdot (D_{sleeve}^4 - d_{sleeve}^4)}{D_{sleeve} \cdot (D_{rod}^4 - d_{rod}^4)}$$

$$C_{spigot} = \frac{D_{rod} \cdot (D_{spigot}^4 - d_{spigot}^4)}{D_{spigot} \cdot (D_{rod}^4 - d_{rod}^4)}$$

$C_{sleeve}$ should be larger than 2.0 or $C_{spigot}$ should be larger than >0.6.

The skilled person understands that the diameters cannot be chosen freely. For example, the outer diameter of the spigot is naturally limited by the inner diameter of the sleeve portion. Also, the outer diameter of the sleeve portion is typically limited by the size of the bore drilled and the requirement for enough space for the flushing away of drill cuttings past the sleeve portion between the sleeve portion and the inner wall of the bore. Similarly, the inner diameter of the spigot limits the rate at which flushing fluid can be pumped through the drill string rod, and thus should not be too small. The design of drill string rods is clearly a difficult balancing act and the present invention guides the skilled person to the selection of a combination of parameters enabling reduced risk of material failures in the drill string rod with sustained flushing performance. To solve this problem has shown to be more difficult than it would seem.

The inventors of the present invention have realized that the drill string rod failures are due to the combination of the increased stiffness of the central rod portion and forced bending of the drill string induced by harder layers or cracks in the rock. The bending of the drill string rod happens while the rod is rotating and thereby creates both additional stress due to bending, and fatigue due to the constant change of bending axis caused by the rotation of the rod in the bore whilst in its bent condition.

The proposed solution is to dimension the spigot and the sleeve portion such that the calculated maximum bending stress in the spigot and the sleeve portion respectively is related to the calculated maximum bending stress in the central rod portion. However, the inventors have realized that the calculated maximum stresses of the sleeve portion and the spigot respectively should not be equal to the calculated maximum bending stress of the central rod portion but rather relate to the calculated maximum bending stress of the central rod portion multiplied by the factor $C_{sleeve}$ or $C_{spigot}$, respectively, in order to account for commonly occurring differences in strength occurring for example due to local material variations likely occurring due to uneven hardening and/or machining at manufacturing of the drill string rods.

In some embodiments, $C_{sleeve}$>2.0 and $C_{spigot}$>0.6. This balance of the first, second, third, fourth, fifth, and sixth diameters involved provide for high reliability and longevity of the drill string rod.

In some embodiments, the base of the spigot is conical.

In some embodiments, the base of the spigot is cylindrical.

In some embodiments, the first diameter ($d_{rod}$) is 30 mm, wherein the second diameter ($D_{rod}$) is 57 mm, wherein the third diameter is ($D_{spigot}$) is 48 mm, wherein the fourth diameter ($d_{spigot}$) is 21 mm, wherein the firth diameter is ($D_{sleeve}$) is 76 mm and wherein the sixth diameter ($d_{sleeve}$) is 51 mm.

In some embodiments, the drill string rod is suitable for use with a drill bit having an outer seventh diameter ($D_{hole}$), wherein the fifth diameter is <0.90*the seventh diameter ($D_{hole}$).

A further aspect relates to a system comprising a plurality of drill string rods according to the first aspect described above.

In some embodiments, the drill string rods of the system are of the type mentioned above which are suitable for use with a drill bit having an outer seventh diameter ($D_{hole}$), wherein the fifth diameter is <0.90*the seventh diameter ($D_{hole}$), and wherein the system further comprises the drill bit.

The difference in diameter between the hole and the outer diameter of the sleeve portion enables efficient flushing of drill cuttings past the sleeve portion, whilst providing robust drill string rods capable of handling the forces involved.

In some embodiments, the seventh diameter is >89 mm. The drill string rods have a second diameter between 30 and 60 mm, preferably between 40 and 60 mm, wherein the specified constraints of the involved diameters of the drill string rods governed by $C_{sleeve}$ and $C_{spigot}$ provide for a robust drilling system.

In some embodiments, the threads on the base and the sleeve portion are both straight.

In some embodiments, the threads on the base and the sleeve portion are both cambered.

DETAILED DESCRIPTION

Figure 1:
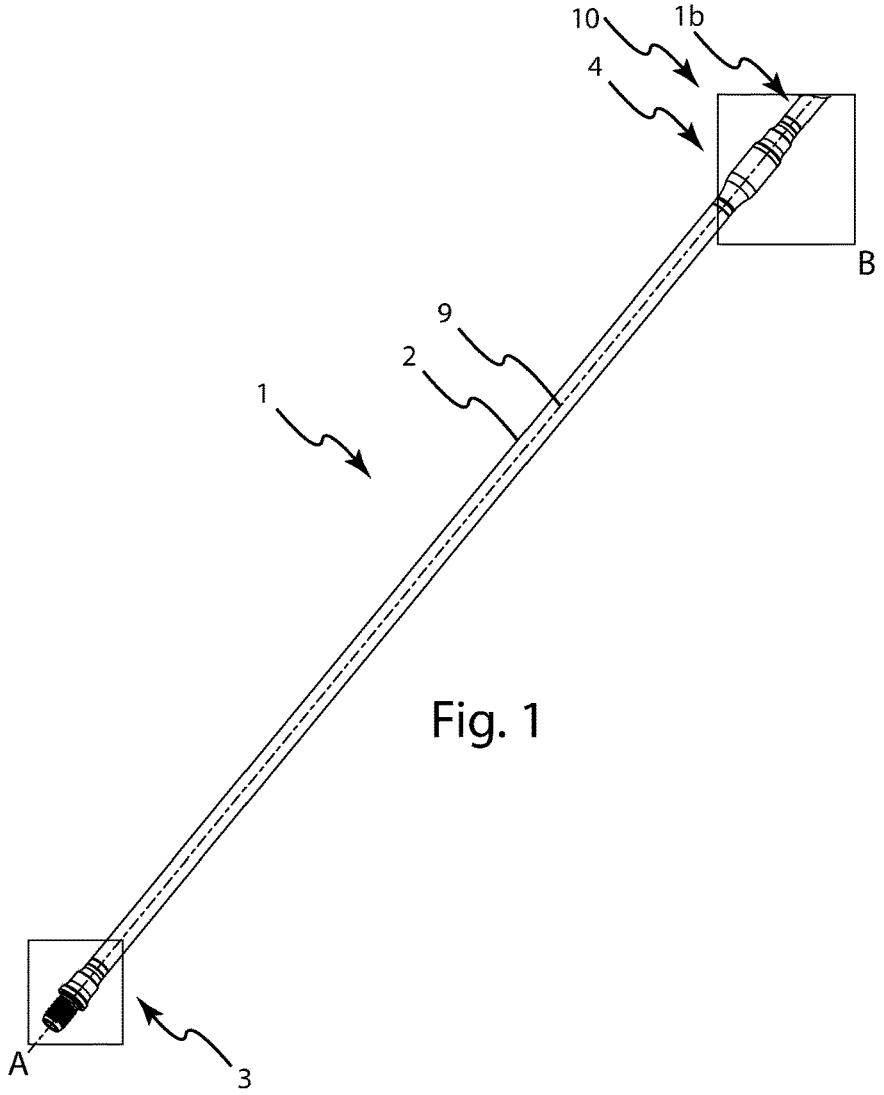
FIG. 1 shows a perspective view of two identical connected drill string rods.
Figure 2:
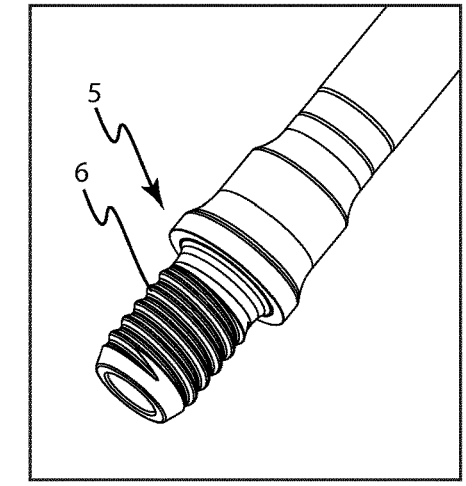
FIG. 2 shows an enlarged perspective view A of the male end of the drill string rod as indicated in FIG. 1.
Figure 3:
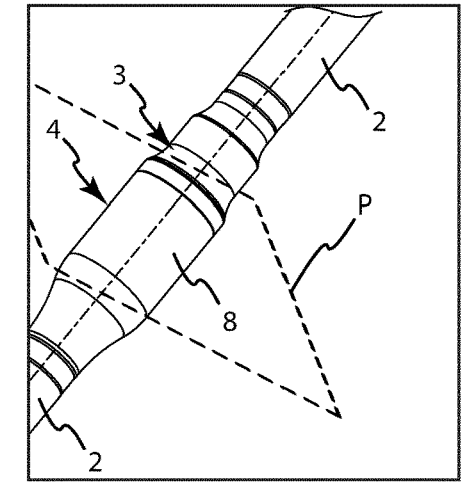
FIG. 3 shows an enlarged perspective view B of the female end of the drill string rod as indicated in FIG. 1, which is connected to the male end of the other drill string rod.
Figure 4:
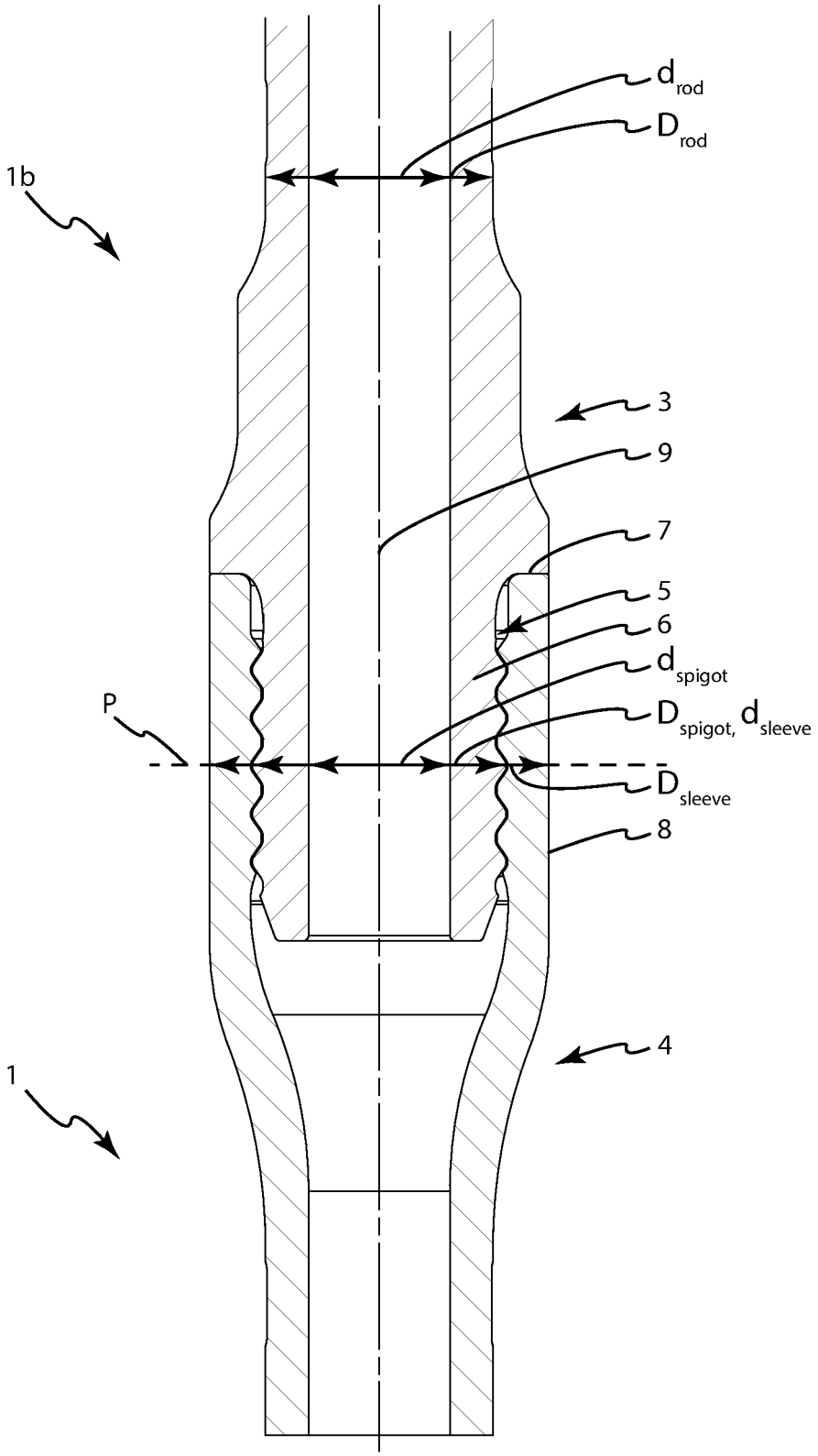
FIG. 4 shows a cross-sectional side view of the sleeve portion and the spigot of the two connected drill string rods also shown in FIG. 1, said cross-section taken in a plane through the longitudinal central axis of the drill string rod.

A first embodiment of the invention is shown in FIGS. 1-4. As shown in the figures, a plurality of identical drill string rods 1, 1*b* are connectable to form a system/assembly 10. The drill string rod 1 comprises an elongate central rod portion 2 extending axially between a male end 3 and a female end 4. As shown in FIG. 4, the central rod portion 2 is hollow-cylindrical defined by an inner first diameter droll and an outer second diameter $D_{rod}$. The male end 3 comprises a spigot 5, and the spigot 5 comprises a base 6 projecting axially from a shoulder 7 that axially separates the spigot 5 and the central rod portion 2. The female end 4 comprises a sleeve/sleeve portion 8 configured to fit to the spigot 5. The base 6 is provided with an outer thread and the sleeve portion 8 is provided with an inner thread, wherein the inner thread corresponds to the outer thread such that the inner thread of the sleeve portion 8 is attachable to the outer thread of the base 6 of the spigot 5 of a further drill string rod of the assembly. In a radial plane P to the longitudinal axis of the drill string rod the base 6 of the spigot 5 is defined by an outer third diameter ($D_{spigot}$) and an inner fourth diameter ($d_{spigot}$) and the sleeve portion 8 is defined by an outer fifth diameter ($D_{sleeve}$) and an inner sixth diameter ($d_{sleeve}$). It should be noted that in FIG. 4, $D_{spigot}$ and $d_{sleeve}$ are both mentioned in connection with the same arrow although in reality the diameters are slightly different with $d_{sleeve}$ being larger than $D_{spigot}$. The scale of the drawing is such that the difference in diameter cannot be shown in FIG. 4 using separate arrows. Although the diameters may vary along the length of the spigot and the sleeve portion respectively, the radial plane P which by necessity runs through both the spigot and the sleeve portion, is used to define the relationship between the diameters in an unambiguous way. The present invention is limited to drill string rods with an outer diameter between 30 and 60 mm, preferably between 40 and 60 mm such as drill bits having a diameter of 54-127 mm. Hence, the second diameter ($D_{rod}$) is between 30-60 mm, preferably between 40-60 mm. $C_{sleeve}$ and $C_{spigot}$ are derivable from/related to the diameters of the drill string rod using the following formulas:

These formulas stem from the calculation of section modulus for hollow-cylindrical beams/bodies which provide a good approximation of the present involved cross-sectional shapes. Specifically, the section modulus equations for hollow-cylindrical cross-sections is:

$$C_{sleeve} = \frac{D_{rod} \cdot (D_{sleeve}^4 - d_{sleeve}^4)}{D_{sleeve} \cdot (D_{rod}^4 - d_{rod}^4)}$$

$$C_{spigot} = \frac{D_{rod} \cdot (D_{spigot}^4 - d_{spigot}^4)}{D_{spigot} \cdot (D_{rod}^4 - d_{rod}^4)}$$

$$S = \frac{\pi(r_2^4 - r_1^4)}{4r2} = \frac{\pi(d_2^4 - d_1^4)}{32d_2}$$

Figure 5:
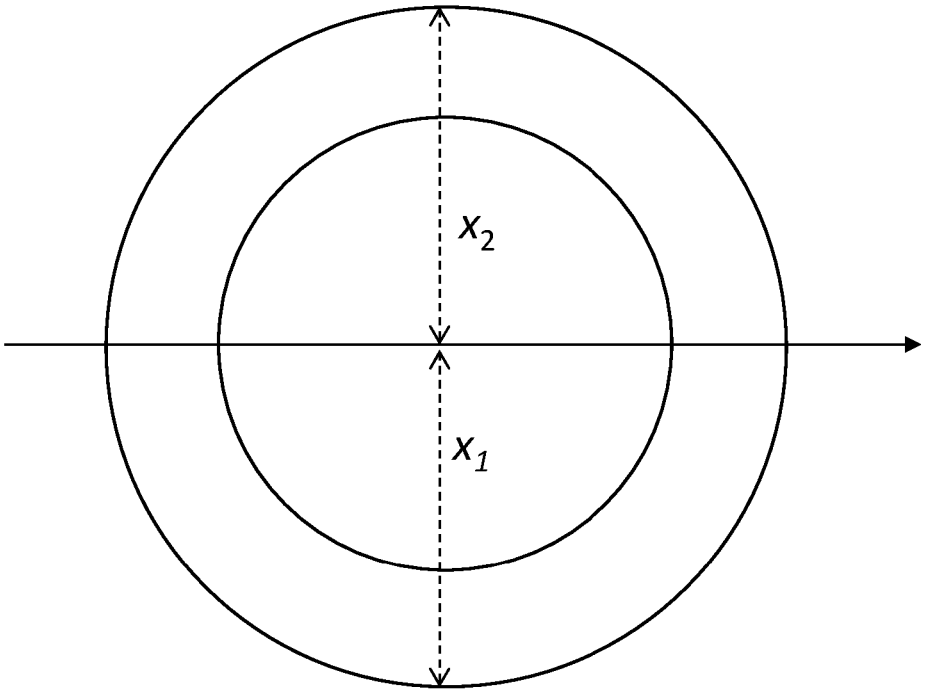
FIG. 5 shows a section modulus hollow round center neutral.

FIG. 5 shows a section modulus hollow round center neutral. Our assumption is that:

$$S_{spigot} = C_{spigot} * S_{rod} \rightarrow \frac{\pi(D_{spigot}^4 - d_{spigot}^4)}{32 * D_{spigot^*}} = \frac{\pi(D_{rod}^4 - d_{rod}^4)}{32 * Drod} * C_{spigot} \rightarrow$$

$$\rightarrow C_{spigot} = \frac{D_{rod^*}(D_{spigot}^4 - d_{spigot}^4)}{D_{spigot^*}(D_{rod}^4 - d_{rod}^4)}$$

And similarly that $S_{sleeve}=C_{sleeve}*S_{rod}\rightarrow$ $$\rightarrow C_{sleeve} = \frac{D_{rod} \cdot (D_{sleeve}^4 - d_{sleeve}^4)}{D_{sleeve} \cdot (D_{rod}^4 - d_{rod}^4)}$$

In this embodiment, the first diameter $d_{rod}$ is 30 mm, wherein the second diameter $D_{rod}$ is 57 mm, wherein the third diameter $D_{spigot}$ is 48 mm, wherein the fourth diameter $d_{spigot}$ is 21 mm, wherein the firth diameter $D_{sleeve}$ is 76 mm and wherein the sixth diameter $d_{sleeve}$ is 51 mm.

This embodiment of the drill string rod 1, 1*b* is suitable for use with a drill bit (not illustrated) having a specified diameter (the diameter not including the drilling inserts) of 54, 57, 64, 70, 76, 89, 102, 115 or 127 mm. The actual diameter of the holes drilled is slightly larger since the drill bits protrude radially. The first through sixth diameters may in other embodiments be chosen differently, as long as the second diameter $D_{rod}$, which defines the outer diameter of the central rod portion 2, fulfills the above constraint of being between 30 and 60 mm, and the other diameters fulfil the constraints that $C_{sleeve}$ is larger than 2.0 or that $C_{spigot}$ is larger than 0.6. Preferably, $C_{sleeve}$ is larger than 2.0 and $C_{spigot}$ is larger than 0.6.

The drill string rods are made of a suitable material, such as steel, and are hardened as needed.

The drill string rod 1, 1*b* is dimensioned based on the size of the drill bit for which it is to be used. However, care must be taken to provide enough space around the sleeve portion 8 for drill cuttings to be flushed past the sleeve portion 8. To this effect, the drill string rod 1, 1*b* may in some embodiments be suitable for use with a drill bit having an outer seventh diameter $D_{hole}$, wherein the outer fifth diameter $D_{sleeve}$ of the sleeve portion 8 is less than 0.90* the seventh diameter $D_{hole}$.

A plurality of identical drill string rods 1, 1*b* may be provided together as part of a system/assembly 10 of the drill string rods 1, 1*b*. The system 10 may alternatively comprise a drill bit. The drill string rods 1, 1*b* of the system 10 may have an outer seventh diameter $D_{hole}$, wherein the fifth diameter is <0.90* the seventh diameter $D_{hole}$, and wherein the system further comprises the drill bit.

The difference in diameter between the hole and the outer fifth diameter $D_{sleeve}$ of the sleeve portion 8 enables efficient flushing of drill cuttings past the sleeve portion 8, whilst providing robust drill string rods 1, 1*b* capable of handling the forces involved.

In some embodiments, the seventh diameter $D_{hole}$ may be 54-127 mm. As mentioned above, the drill string rods of the present invention all have a second diameter between 30 and 60 mm, preferably between 40 and 60 mm. The specified constraints of the involved diameters given by $C_{sleeve}$ and $C_{spigot}$ provide for a robust system/assembly 10.

The invention claimed is:

1. A drill string rod arranged to form part of an assembly of connected drill string rods, the drill string rod comprising:

an elongate central rod portion extending axially between a male end and a female end, wherein the central rod portion is a hollow-cylindrical defined by an inner first diameter ($d_{rod}$) and an outer second diameter ($D_{rod}$), wherein the male end includes a spigot, wherein the spigot includes a base projecting axially from a shoulder that axially separates the spigot and the central rod portion, wherein the female end includes a sleeve portion configured to fit to the spigot, wherein the base is provided with an outer thread and wherein the sleeve portion is provided with an inner thread, wherein the inner thread corresponds to the outer thread such that the inner thread of the sleeve portion is attachable to an outer thread of a base of a spigot of a further drill string rod of the assembly, wherein, in a radial plane to a longitudinal axis of the drill string rod, the base of the spigot is defined by an outer third diameter ($D_{spigot}$) and an inner fourth diameter ($d_{spigot}$) and the sleeve portion is defined by an outer fifth diameter ($D_{sleeve}$) and an inner sixth diameter ($d_{sleeve}$), wherein the second diameter ($D_{rod}$) is between 30-60 mm, wherein a relationship between outer diameters of the sleeve ($C_{sleeve}$) and a relationship between outer diameters of the spigot ($C_{spigot}$) are defined as:

$$C_{sleeve} = \frac{D_{rod} \cdot (D_{sleeve}^4 - d_{sleeve}^4)}{D_{sleeve} \cdot (D_{rod}^4 - d_{rod}^4)}$$

$$C_{spigot} = \frac{D_{rod} \cdot (D_{spigot}^4 - d_{spigot}^4)}{D_{spigot} \cdot (D_{rod}^4 - d_{rod}^4)}$$

and wherein $C_{sleeve}>2.0$ or $C_{spigot}>0.6$.

2. The drill string rod according to claim 1, wherein $C_{sleeve}>2.0$ and $C_{spigot}>0.6$.

3. The drill string rod according to claim 1, wherein the base of the spigot is conical.

4. The drill string rod according to claim 1, wherein the base of the spigot is cylindrical.

5. The drill string rod according to claim 1, wherein the first diameter ($d_{rod}$) is 30 mm, wherein the second diameter ($D_{rod}$) is 57 mm, wherein the third diameter ($D_{spigot}$) is 48 mm, wherein the fourth diameter ($d_{spigot}$) is 21 mm, wherein the fifth diameter ($D_{sleeve}$) is 76 mm and wherein the sixth diameter ($d_{sleeve}$) is 51 mm.

6. The drill string rod according to claim 1, wherein the drill string rod is suitable for use with a drill bit having an outer seventh diameter ($D_{hole}$), wherein the fifth diameter ($D_{sleeve}$) is <0.90* the seventh diameter ($D_{hole}$).

7. A system comprising a plurality of drill string rods according to claim 1.

8. The system according to claim 7, further comprising a drill bit having an outer seventh diameter ($D_{hole}$), wherein the fifth diameter ($D_{sleeve}$) is <0.90* the seventh diameter ($D_{hole}$).

9. The system according to claim 8, wherein the seventh diameter ($D_{hole}$) is 54-127 mm or larger.

10. The system according to claim 7, wherein the second diameter ($D_{rod}$) is between 40-60 mm.

11. The system according to claim 7, wherein the threads on the base and the sleeve portion are both straight.

12. The system according to claim 7, wherein the threads on the base and the sleeve portion are both cambered.

* * * * *